US006092800A

United States Patent [19]

Compera et al.

[11] Patent Number: 6,092,800

[45] Date of Patent: Jul. 25, 2000

[54] DEVICE FOR CONVEYING SHEETS IN A PRINTING MACHINE

[75] Inventors: Christian Compera, Schoenau; Walter Dworschak, Gettorf; Gerhard Bartscher, Kiel; Patrick Metzler, Wendel, all of Germany

[73] Assignee: Heidelberger Druckmaschinen AG, Heidelberg, Germany

[21] Appl. No.: 09/105,476

[22] Filed: Jun. 26, 1998

[30] Foreign Application Priority Data

Jun. 26, 1997 [DE] Germany ..... 197 27 156

[51] Int. Cl.[7] ..... B65H 29/30

[52] U.S. Cl. ..... 271/193; 198/691

[58] Field of Search ..... 271/193; 198/691

[56] References Cited

U.S. PATENT DOCUMENTS

| | | | |
|---|---|---|---|
| 3,690,646 | 9/1972 | Kolibas | 198/691 |
| 3,717,801 | 2/1973 | Silverberg | 317/262 E |
| 4,244,465 | 1/1981 | Hishikawa et al. | 198/691 |
| 4,526,357 | 7/1985 | Kuehnle et al. | 271/18.2 |
| 4,856,769 | 8/1989 | Andrew et al. | 198/691 |
| 4,864,461 | 9/1989 | Kasahara | 271/193 |
| 5,003,325 | 3/1991 | Bibl | 271/193 |
| 5,121,170 | 6/1992 | Bannai et al. | 355/326 |
| 5,593,151 | 1/1997 | Mastare et al. | 271/193 |

FOREIGN PATENT DOCUMENTS

| | | | |
|---|---|---|---|
| 0 113 115 | 7/1984 | European Pat. Off. . | |
| 0 297 227 | 1/1989 | European Pat. Off. . | |
| 1 073 396 | 1/1960 | Germany . | |
| 1 232 649 | 7/1967 | Germany . | |
| 21 63 291 | 9/1980 | Germany . | |
| 39 09 514 | 10/1989 | Germany . | |
| 40 15 210 | 11/1990 | Germany . | |
| 40 12 510 | 10/1991 | Germany . | |
| 42 17 618 | 3/1995 | Germany . | |
| 196 43 106 | 4/1997 | Germany . | |
| 361124455 | 6/1986 | Japan | 198/691 |
| 406171755 | 6/1994 | Japan | 198/691 |

*Primary Examiner*—Christopher P. Ellis
*Assistant Examiner*—Khoi H. Tran
*Attorney, Agent, or Firm*—Kenyon & Kenyon

[57] ABSTRACT

A device for conveying thin workpieces in a machine used in printing technology, which device includes at least one moving conveying element, on whose surface are formed areas of changing charge density, the adherence of the workpiece on the conveying element being supported by electrostatic forces wherein contacts are provided for forming the areas of changing charge density, the contacts touching the conveying element and being connected to at least one voltage source, and an electric current flow being present, via the contacts in the material of the conveying element.

9 Claims, 4 Drawing Sheets

DEVICE FOR CONVEYING SHEETS IN A PRINTING MACHINE

FIELD OF THE INVENTION

The invention relates to a device for conveying sheets in a printing machine such as a printing press.

RELATED TECHNOLOGY

It is known to retain and transport sheets with the aid of electrostatic means. In the design approach shown in the U.S. Pat. No. 4,244,465, the sheets are transported on a conveyor belt, into which are integrated two groups of strip-shaped and equally-spaced electrodes. The electrodes are surrounded by an insulating material. The electrodes are connected via contacts to a high-voltage source, so that an electrostatic field is generated over the surface of the conveyor belt. A disadvantage of this design approach is that the electrodes rotate with the belt. Due to this, an increased wear and tear of the electrodes and of the belt arises. Furthermore, the structure of the electrodes stands out at the surface of the conveyor belt, thus impairing the evenness of the bearing surface, which can be disadvantageous when conveying and processing thin sheets. The retention forces acting on the sheets are reduced by surface discharges; because of this, it can be necessary to reverse the polarity of the high voltage. The non-uniform field emanating from the electrodes cannot be completely compensated for by the sheets, which means increased dust accumulations appear on the conveyor belt. Due to a parasitic corona, which can develop during the removal of the sheets from the conveyor belt, surface charges collect in the insulating layer covering the electrodes. Because of this, the surface of the conveyor belt can become deactivated, as a result of which, the dynamic effect on the sheets can be lost.

A separating device for sheets based on the same principle is described in the U.S. Pat. No. 4,526,357.

In European Patent Application No. EP 0 297 227 A2, an electrostatic retaining device is shown, in which electrodes are embedded in pairs in a base material, the electrodes being connected to voltage sources which change their polarity in an alternating manner.

In German Patent Application 40 12 510 A1, a sheet-transport device having a continuous belt is shown, in which no electrodes are provided in the belt material. With the aid of an electrode that extends over the width of the belt and is connected to an a.c. voltage source, a charge-density pattern is formed in a contacting manner on the belt surface. The non-uniform electrical field resulting influences image charges in the sheet material, resulting in a retention force of the sheets on the belt surface.

To achieve uniform retention forces, the frequency of the a.c. voltage should be in phase with the rotational speed of the belt, which brings with it an expenditure from the standpoint of control engineering. Since the in-phase condition cannot be realized completely, for example, positively charged areas become negatively charged during the next belt rotation. The corona associated with this recharge stresses the environment with ozone and nitrogen oxides. The energy consumption is increased. Especially given small distances between the positively and negatively charged areas on the belt surface, several recharges occur, both when the belt runs into and runs out of the effective range of the charging electrode.

The use of a.c. voltage increases the tendency to creeping discharges along the insulating surface of the belt. Because of the finite ohmic resistance at the belt surface, charge spacings of more than 1 mm are optimal. This makes it possible for the sheet to be so placed on the belt, that the front edges of the sheet have a certain clearance with respect to a charge extreme. Because of this, the maximum retention force cannot act on the front edges of the sheet, which would be desirable for many applications.

According to the design approach in German Patent Application No. 40 12 510 A1, provision is made for a blade-shaped electrode or a charging roll, which have a large spatial expansion. When using high a.c. voltages, capacitive interference injections can occur in electronic circuits, which can only be attenuated by an extra expense for screening plates, filters, and the like.

If the intention is to use the charging roll simultaneously as a tension roll for the internally conductive belt, then, because of the looping angle, a high capacitance exists between the charging roll and the belt. Due to this, a high reactive power, or a high power demand develops in response to the application of the a.c. voltage.

SUMMARY OF THE INVENTION

The present invention relates to a device for the conveyance of thin workpieces in a machine used for printing-technology applications. The conveying element carrying the thin workpieces is simply constructed, has no surface structure hindering the transport and the process occurring in the printing-technology machine, and exhibits a long service life. In addition, the device can minimize the residual or net charges remaining on the thin workpieces, and the negative environmental influences.

The present invention therefore provides a device for conveying thin workpieces in a machine used in printing technology, including at least one moving conveying element on whose surface are formed areas having changing charge density, wherein the adherence of the workpiece on the conveying element being supported by electrostatic forces. The device is characterized in that provision is made for contacts (5) for forming the areas of changing charge density, the contacts (5) touching the conveying element (1) and being connected to at least one voltage source (7,8), and an electric current flow (I) being present, via the contacts (5), in the material of the conveying element (1).

According to the present invention, a current flow is produced in the material of a conveying element between two contacts, the current flow giving rise to an essentially linear voltage drop because of the specific electrical resistance of the conveying-element material. A transition area having a distinct transition resistance exists between the conveying-element material and the workpiece lying on it. The transition resistance results from the roughness of the workpiece, and the pointwise resting of the workpiece on the conveying element associated with that. The transition resistance can be artificially increased or produced, if the bearing surface of the conveying element is provided with a thin, insulating coating. Because of the voltage drop in the conveying-element material, a charge-carrier displacement results in the workpiece material. The holding-force action of the workpiece on the surface of the conveying element caused by this is essentially proportional to the square of the difference between the potential of the conveying element and the potential of the workpieces. The maximum dynamic effect between the workpiece and the conveying element develops in the touching area of the contacts on the conveying element.

A belt or a hollow cylinder, for example, can be used as a conveying element. Conductive rolls, brush-shaped elements, sliding contacts, or movable contact rings or contact bands, for example, can be provided as contacts. The specific electrical resistances and the relative dielectric constants of the materials of the conveying element, of the workpiece, and of the aforesaid transition area are so dimensioned, that the charge displacement of the workpieces can take place within the entire transport-speed range of the workpiece. The direct-current sources can be provided in a manner that they are adjustable, in conformity with the transport speed of the workpiece, and in conformity with the transport conditions such as atmospheric pressure and humidity. Furthermore, the contact spacings can be adjustable, in order to achieve an adaptation to the dimensions and weight distribution of the individual workpieces.

BRIEF DESCRIPTION OF THE DRAWINGS

Further features and advantages of the present invention are evident from the following description of several exemplary embodiments, in which.

DETAILED DESCRIPTION

Figure 1:
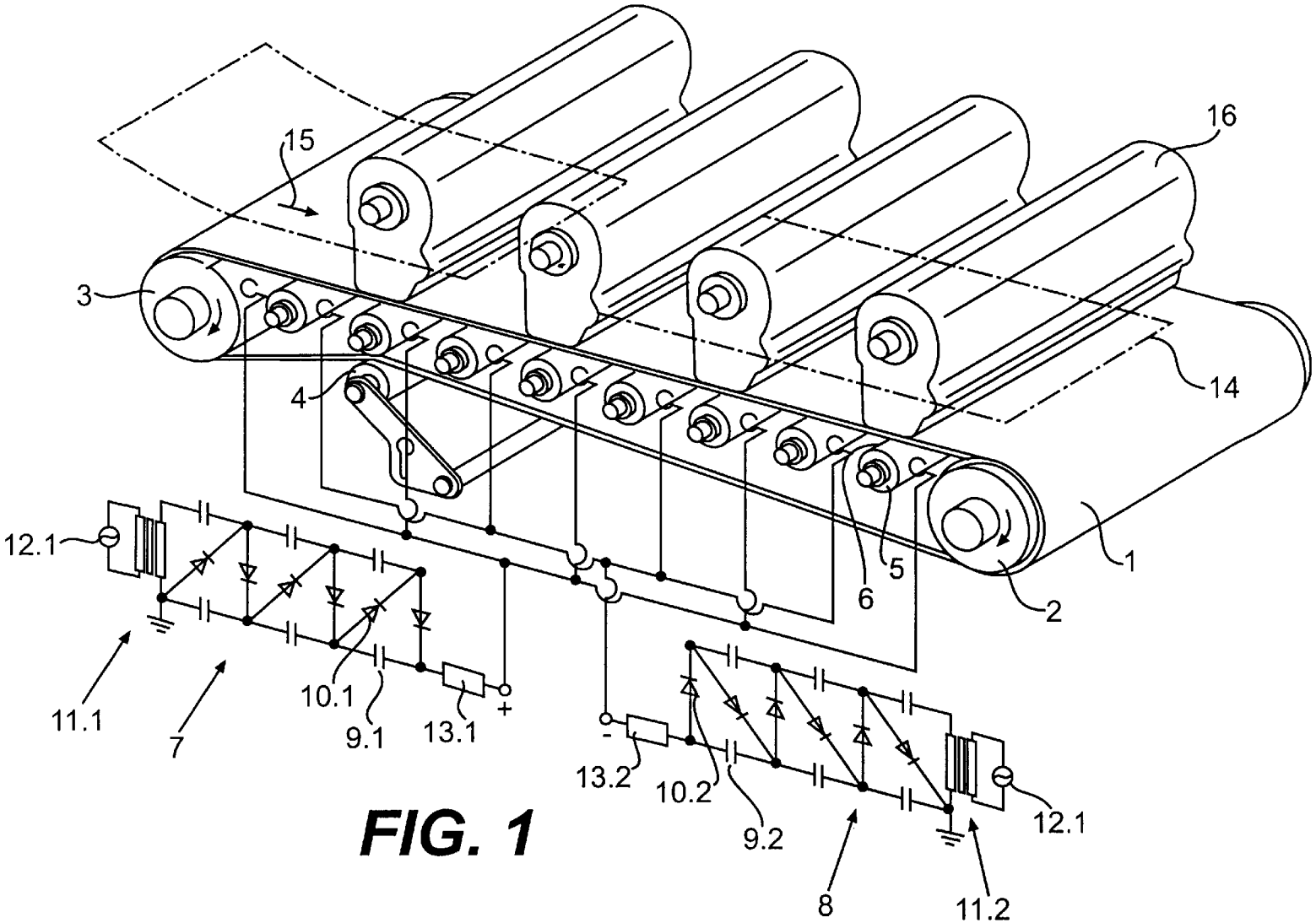
FIG. 1: shows a schematic view of a conveying device having a conveyor belt.
Figure 4:
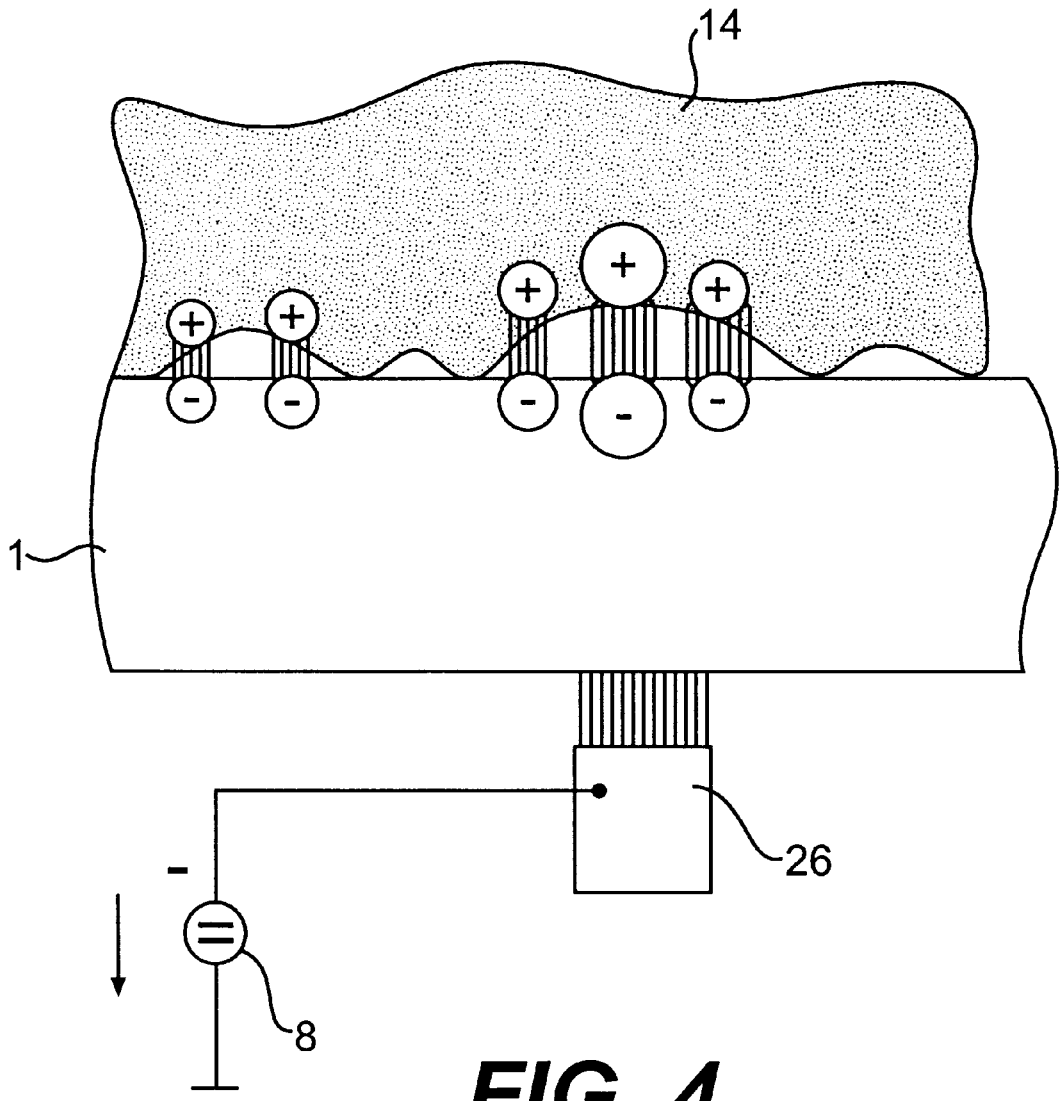
FIG. 4: shows a schematic view of a brush shaped charge contact.

The conveying device shown in FIG. 1 includes a conveyor belt 1 which is placed over guide rolls 2 and 3, and which is tightened by a tension roll 4. In the upper side, conveyor belt 1 is supported by contact rolls 5. Contact rolls 5 are made of an electrically conductive material. In a different embodiment shown in FIG. 2, the contact rolls 5' can be hollow. In each case, the equally-spaced contact rolls 5 are connected via sliding contacts 6 to a direct-voltage source 7,8. The contacts can be brush shaped contacts 26, as shown in FIG. 4. Each direct-voltage source 7,8 contains a cascade of capacitors 9.1,9.2 and diodes 10.1,10.2. On the incoming side, the cascades are connected to the secondary winding of a transformer 11.1,11.2, whose primary winding is in each case connected to an a.c. voltage source 12.1,12.2. On the output side, the cascades are connected via series resistors 13.1,13.2 to contact rolls 5.

The positive potential of direct-voltage source 7 is applied via sliding contacts 6 to each second contact roll 5 and to guide roll 3. The negative potential of direct-voltage source 8 is applied to intervening contact rolls 5. The conveying device is a component of a printing device for sheets 14 which, with the aid of conveyor belt 1, are led in direction 15 past four printing units 16.

Figure 2:
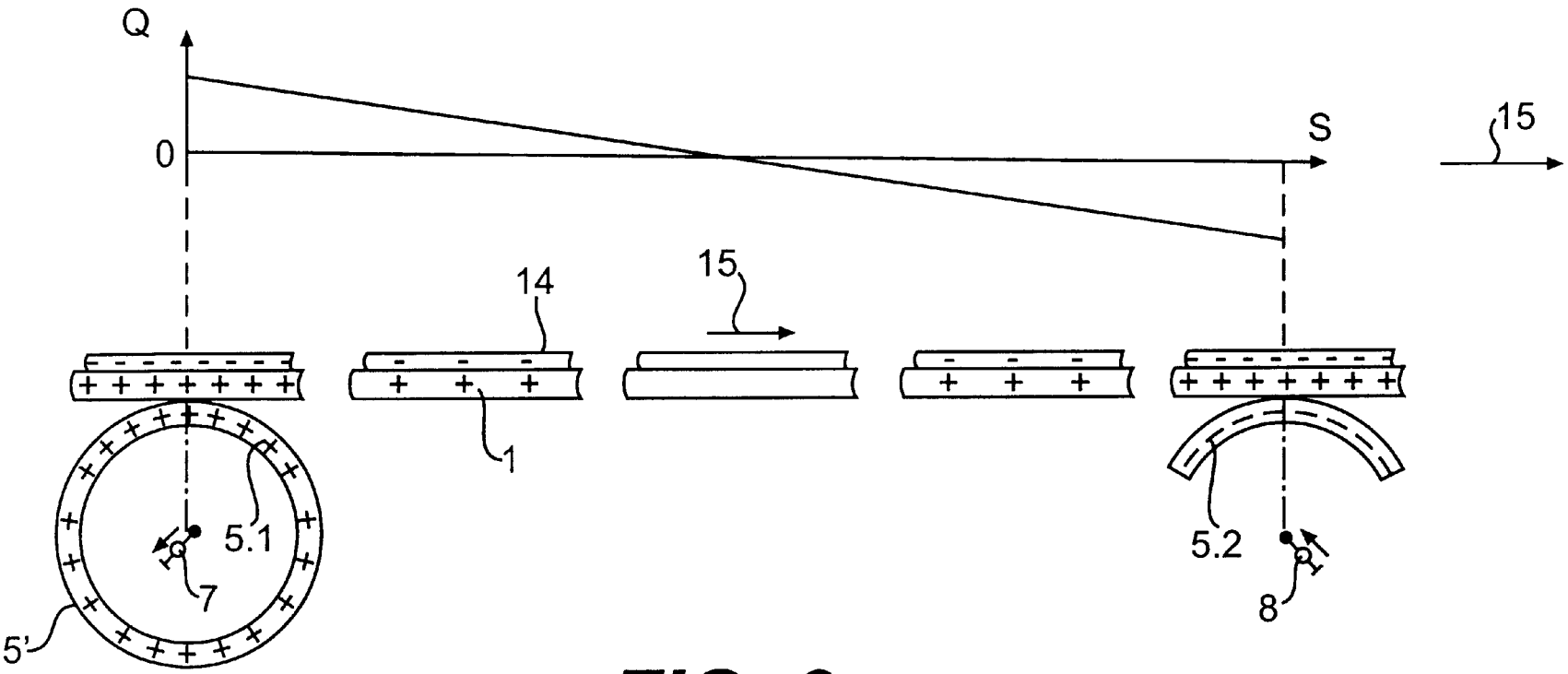
FIG. 2: shows a schematic view depicting the charge distribution between two contact rolls.

FIG. 2 shows more precisely how the potential relationships between two contact rolls 5 develop. Due to the connection to direct-voltage source 7, contact roll 5.1 is at positive potential Q. Adjacent contact roll 5.2 is connected to direct-voltage source 8, and is at negative potential Q. The material of conveyor belt 1, which is conductive to a limited extent, has a specific electrical resistance $\rho_F$ and exhibits a relative dielectric constant $\epsilon_{r,F}$.

A current flow I and a steady potential gradient develops in the material of conveyor belt 1, as is shown in FIG. 2. An electrically insulating separating layer, having a specific electrical resistance $\rho_T$ and a relative dielectric constant $\epsilon_{r,T}$. exists between the contact area of sheets 14 on conveyor belt 1, and sheets 14 themselves. Because of this separating layer, charges, which have an opposite polarity as is present in the material of conveyor belt 1 due to the aforesaid potential gradient, are influenced in the material of sheets 14, which have a specific electrical resistance $\rho_W$ and a relative dielectric constant $\epsilon_{r,W}$. The opposite charges attract each other. A dynamic effect develops on sheets 14, which is explained more precisely in FIG. 3.

In one preferred embodiment, the specific electrical resistances and the relative dielectric constants are related as follows:

$$\rho_F{}^*\epsilon_{r,F}<T<\rho_T{}^*\epsilon_{r,T} \text{ and}$$

$$\rho_W{}^*\epsilon_{r,W}<T<\rho_T{}^*\epsilon_{r,T} \text{ where}$$

$$\rho_F{}^*\epsilon_{r,F}<\rho_T{}^*\epsilon_{r,T} \text{ and}$$

$$\rho_W{}^*\epsilon_{r,W}<\rho_T{}^*\epsilon_{r,T}.$$

Figure 3:
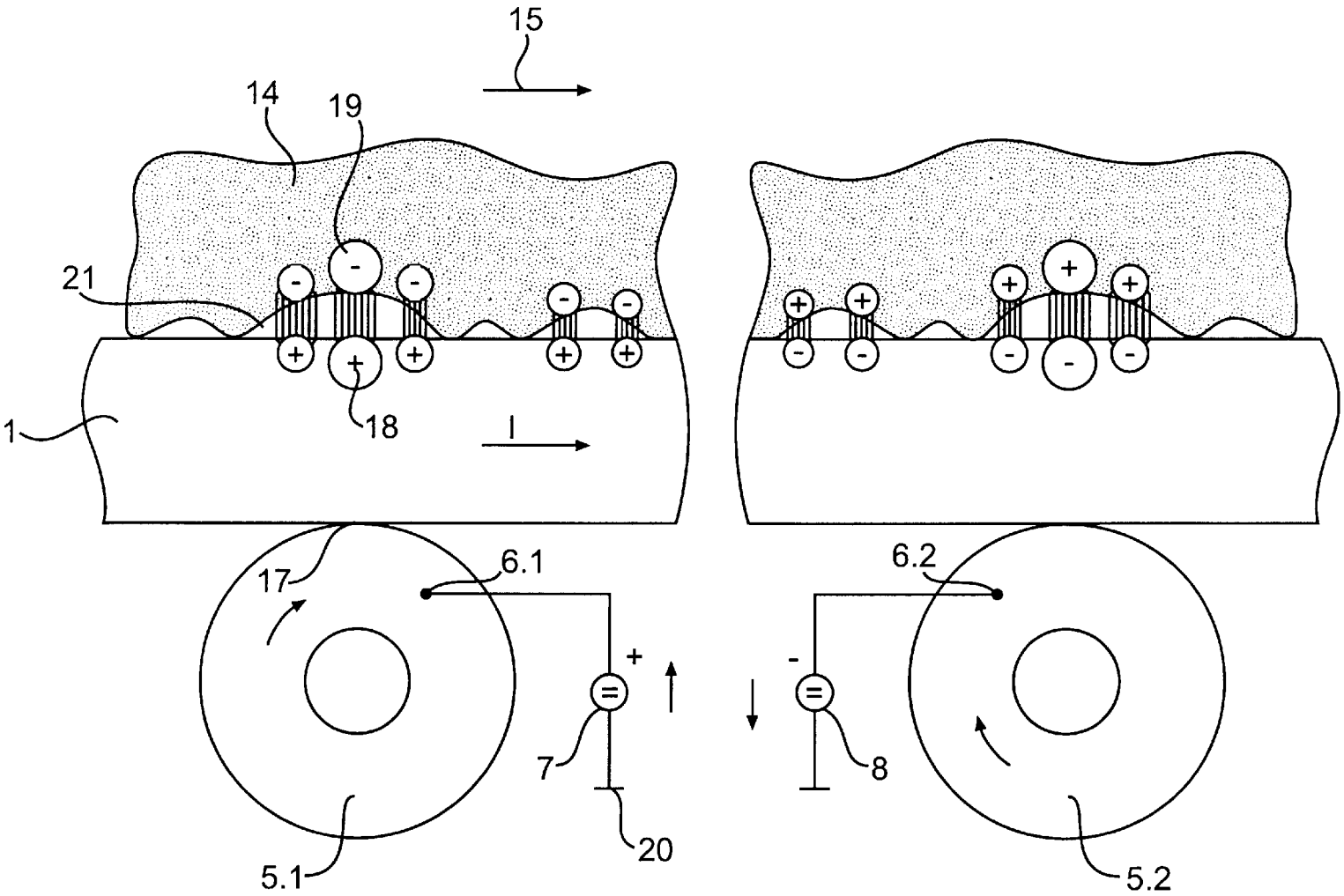
FIG. 3: shows a schematic view depicting the development of image charges between conveying element and workpiece.

FIG. 3 shows schematically and greatly enlarged, how the charge-carrier displacement comes about in the material of sheets 14. Conveyor belt I is strongly positively charged at point of contact 17 of contact roll 5.1 with conveyor belt 1. Charges 19 having an opposite sign collect in the material of sheet 14 near positive charges 18. Charges 19, influenced in sheet 14, exert forces on influencing charges 18. In this manner, sheet 14 is attracted by conveyor belt 1. Specific to ground potential 20, virtually no influencing charges 18 are present any longer between two adjacent contact rolls 5.1 and 5.2. The retention forces here are minimal. As already mentioned above, a potential gradient exists between contact rolls 5.1 and 5.2 because of current flow I. The diameter of charges 18, 19 shown in FIG. 3 is intended to show clearly that the retention forces between sheets 14 and conveyor belt 1 increase or decrease linearly according to the potential gradient. As is obvious in FIG. 3, influencing charges 19 only develop where an electrically insulating intermediate layer 21 exists between sheet 14 and conveyor belt 1. In this exemplary embodiment, intermediate layer 21 is present naturally due to the roughness and unevenness of sheets 14. In an exemplary embodiment, not further shown, a thin layer can be applied on conveyor belt 1, which acts as intermediate layer 21.

What is claimed is:

1. A device for conveying a thin workpiece in a machine used in printing technology comprising:

a moving conveying element having a surface for adhering the workpiece with the aid of electrostatic forces, the surface having areas of changing charge density;

a plurality of contacts creating alternate areas of changing charge density, the contacts being disposed along a length of the moving conveying element opposite to the surface for adhering the workpiece and being connected to the conveying element; and at least one voltage source connected to the plurality of contacts so that an electric current flow results in the conveying element via the contacts.

2. The device as recited in claim 1 further comprising an insulating, separating layer having a specific electrical resistance $\rho_T$ and a relative dielectric constant $\epsilon_{r,T}$, the separating layer located between the conveying element and the thin workpiece being conveyed on the conveying element, the conveying element having a specific electrical resistance $\rho_F$ and a relative dielectric constant $\epsilon_{r,F}$, the workpiece being conductive and having a specific electrical resistance $\rho_W$ and a relative dielectric constant $\epsilon_{r,W}$, and there being a transport time T of the conveying element and of the workpiece between two contacts of the plurality of contacts, wherein $$\rho_F{}^*\epsilon_{r,F}<T<\rho_T{}^*\ \epsilon_{r,T} \text{ and}$$

$$\rho_W{}^*\epsilon_{r,W}<T<\rho_T{}^*\ \epsilon_{r,T} \text{ where}$$

$$\rho_F{}^*\epsilon_{r,F}<\rho_T{}^*\epsilon_{r,T} \text{ and}$$

$$\rho_W{}^*\epsilon_{r,W}<\rho_T{}^*\epsilon_{r,T}.$$

3. The device as recited in claim 1 wherein the conveying element includes a continuous conveyor belt and two guide rolls, the plurality of contacts being located against an inner side of the conveyor belt and including a plurality of supporting rolls contacting the conveyor belt, the plurality of supporting rolls being distributed along the conveying belt and being connected to the at least one voltage source, a voltage difference existing between adjacent supporting rolls.

4. The device as recited in claim 3 wherein the at least one voltage source includes two d.c. voltage sources.

5. The device as recited in claim 1 wherein the at least one voltage source is a d.c. voltage source and further comprising sliding contacts for connecting the contacts and the at least one voltage source.

6. The device as recited in claim 1 wherein the conveying element includes an electrically conductive hollow cylinder.

7. The device as recited in claim 1 wherein the contacts are brush-shaped.

8. The device as recited in claim 1 wherein the at least one voltage source is a d.c. voltage source.

9. The device as recited in claim 1 wherein the at least one voltage source includes two voltage sources.

* * * * *